US009745696B2

(12) United States Patent
Barrett

(10) Patent No.: US 9,745,696 B2
(45) Date of Patent: Aug. 29, 2017

(54) PAPER MAKER FABRIC

(71) Applicant: Heimbach GmbH & Co. KG, Duren (DE)

(72) Inventor: Rex Barrett, Neenah, WI (US)

(73) Assignee: Heimbach GmbH & Co. KG (DE)

( * ) Notice: Subject to any disclaimer, the term of this patent is extended or adjusted under 35 U.S.C. 154(b) by 241 days.

(21) Appl. No.: 14/604,048

(22) Filed: Jan. 23, 2015

(65) Prior Publication Data

US 2015/0211178 A1 Jul. 30, 2015

(30) Foreign Application Priority Data

Jan. 28, 2014 (EP) ..... 14152822

(51) Int. Cl.
*D21F 1/00* (2006.01)
*D21F 1/10* (2006.01)
*D03D 11/00* (2006.01)

(52) U.S. Cl.
CPC ..... *D21F 1/0045* (2013.01); *D03D 11/00* (2013.01)

(58) Field of Classification Search
CPC ..... D21F 1/10; D21F 1/105; D21F 1/0027; D21F 1/0036; D21F 1/0045; D21F 1/0054; D21F 7/08; D21F 7/083; D21F 7/12; D03D 3/04; D03D 11/00; D03D 13/00
USPC .... 162/348, 296, 900, 902, 903; 139/383 A, 139/425 A
See application file for complete search history.

(56) References Cited

U.S. PATENT DOCUMENTS

| | | | | |
|---|---|---|---|---|
| 4,554,953 | A | 11/1985 | Borel et al. | |
| 4,564,051 | A | 1/1986 | Odenthal | |
| 5,052,448 | A | 10/1991 | Givin | |
| 5,152,326 | A | 10/1992 | Vöhringer | |
| 5,437,315 | A | 8/1995 | Ward | |
| 5,826,627 | A | 10/1998 | Seabrook et al. | |
| 2005/0268981 | A1* | 12/2005 | Barratte | D21F 1/0045 139/383 A |
| 2008/0035230 | A1 | 2/2008 | Danby et al. | |
| 2008/0264511 | A1* | 10/2008 | Boeck | D21F 1/0045 139/383 A |
| 2010/0258259 | A1* | 10/2010 | Boeck | D21F 1/0045 162/289 |

FOREIGN PATENT DOCUMENTS

| | | | |
|---|---|---|---|
| DE | 29807274 | U1 | 7/1998 |
| DE | 102004016640 | B3 | 8/2005 |
| EP | 1365066 | A1 | 11/2003 |
| EP | 1605095 | A1 | 12/2005 |
| EP | 1506339 | B1 | 4/2007 |

(Continued)

*Primary Examiner* — Eric Hug
(74) *Attorney, Agent, or Firm* — Berenato & White, LLC

(57) ABSTRACT

A fabric having a first woven fabric layer forming a paper side and made of first threads, and a second woven fabric layer made of second threads, the two woven fabric layers being connected by binder threads belonging to the first woven fabric layer such that at binding points the respective binder thread binds with one first thread on the paper side, then changes to the second woven fabric layer and binds with at least two second threads and then returns to the first woven fabric layer again and binds with a first thread on the paper side, wherein at binding points only one first thread is not bound by the said binder thread.

20 Claims, 1 Drawing Sheet

(56) References Cited

FOREIGN PATENT DOCUMENTS

| | | | |
|---|---|---|---|
| EP | 1936024 | A1 | 6/2008 |
| EP | 2314762 | A1 | 4/2011 |
| JP | 49010281 | B | 3/1974 |
| JP | 62-78294 | A | 4/1987 |
| WO | 03093573 | A1 | 11/2003 |
| WO | 2005017254 | A1 | 2/2005 |
| WO | 2006020414 | A1 | 2/2006 |
| WO | 2012120191 | A1 | 9/2012 |

* cited by examiner

PAPER MAKER FABRIC

CROSS-REFERENCE TO RELATED APPLICATIONS AND CLAIM TO PRIORITY

This application is based upon Patent Application No. 14152822.4 filed Jan. 28, 2014 in the European Patent Office, the disclosure of which is incorporated herein by reference and to which priority is claimed.

FIELD OF THE INVENTION

The invention relates to a paper maker fabric particularly usable as a forming fabric in a forming section of a paper making machine having a first woven fabric layer forming a paper side on its outside and made of first threads interwoven with one another, and a second woven fabric layer forming a machine side on its outside and made of second threads interwoven with one another, the two woven fabric layers being connected to one another by intrinsic binder threads belonging to the first woven fabric layer such that at binding points the respective binder thread binds with a first thread extending transversely to the binder thread by passing over its paper side, than changes to the second woven fabric layer and binds with at least two adjacent second threads extending transversely to the binder thread by passing over their machine side and then returns to the first woven fabric layer again and binds with a first thread extending transversely to the binder thread on the paper side.

BACKGROUND OF THE INVENTION

Woven papermaker fabrics are intended to be used in the sections of a paper making machine as a support for the paper web. They are endless woven fabrics or fabrics made endless by means of a seam which circulate in the paper making machine. In the first section of a paper making machine, forming fabrics are used, on the top surface of which a paper pulp is disposed at the start, and the latter is dewatered through the forming fabric such as to form a paper web, wherein the dewatering is supported in particular by suction boxes disposed on the bottom or machine side of the fabric.

A paper maker fabric must have a fine structure on the paper side in order to support and retain a high percentage of the deposited paper fibers. On the other hand, the machine side of such a fabric must be durable enough to withstand wear and give adequate life, strong enough to resist tensile forces and open enough to provide drainage. Meeting these criteria generally requires that at least two fabric layers are superimposed utilizing threads of different size and/or count per cm and differing weave patterns.

Generally known are three types of paper maker fabrics used for the forming section of a paper making machine. A first type is constructed of an upper and a lower layer out of transverse threads, the threads of both layers are superposed in pairs. The fabric layers are connected by longitudinal threads mostly interwoven in the upper layer and only a portion of them additionally interwoven in the lower layer, the threads of which are preferably of a larger thickness than the longitudinal threads. Such kind of forming fabrics are commonly called double-layer fabrics.

The second type of fabrics is created from two distinct fabrics, one having the qualities desired for the paper side and the other the qualities desired for the machine side. The two fabrics are stitched or bound together by additional or independent binder yarns, which do not belong to the recurring woven fabric repeats formed by the longitudinal and transverse threads of both layers. This type of papermaker fabric is commonly called a triple-layer fabric.

The third type of papermaker fabric is based on the second type, i.e. has two distinct fabric layers comprising longitudinal and transverse threads interwoven with one another respectively. Unlike the triple-layer fabrics, this type of fabric has no additional or independent binder threads. The connection of the two layers is made of their own threads, i.e. by so-called "structural", "intrinsic" or "fabric-born" threads. These are threads which are an integral part of the weave pattern of the fabric or its woven fabric repeats. Composite fabrics of these types are commonly called SSB (sheet support binder) fabrics.

Differences between the foregoing three types of fabrics are also described in U.S. Pat. No. 5,152,326, columns 1 and 2, U.S. Pat. No. 5,052,448, columns 1 through 3 and U.S. Pat. No. 4,554,953, columns 1 through 3.

Paper maker fabrics of the SSB composite type are known, wherein the connection between the two layers is achieved by a number of intrinsic binder thread pairs, the binding of the one binder thread in one layer is continued by the other binder thread of the binder thread pair, if the one binder thread changes from one layer to the other layer in a symmetrical manner (U.S. Pat. No. 5,152,326; US 2008/0035230 A1; EP 1 605 095 A1 and EP 1 365 066 A1; US 2010/0258259 A1; U.S. Pat. No. 5,826,627; WO 2005/017254 A1). Also known are embodiments of composite papermaker fabrics, wherein the two layers are connected by intrinsic binder threads belonging to the first woven fabric layer (U.S. Pat. No. 4,564,051; U.S. Pat. No. 5,052,448; U.S. Pat. No. 4,554,953; EP 2 314 762 A1; JP 49010281 B; JP 62-78294; DE 298 07 274 U1 and EP 1 365 066 A1; EP 1 506 339 A1; WO 2006/020414 A1; EP 1 936 024 A1; DE 10 2004 016 640 B3). In the latter document, an embodiment is also disclosed, wherein the two layers are connected by binder threads of the second woven fabric layer forming the machine side layer.

With respect to SSB composite type paper maker fabrics as mentioned above, it is commonly known that the binder threads bind with only one second thread of the second woven fabric at a binding point. In order to obtain a strong connection between the two woven fabric layers, it is necessary to form a large number of the first threads in one direction as binder threads. The disadvantage is that the machine side of the paper maker fabric is uneven due to the large number of binding points where the binder threads changes to the second woven fabric layer and hence, create recesses or dimples. However, embodiments of SSB paper maker fabrics are known, wherein the binder threads bind with two or more adjacent second threads at one binding point (US 2010/0258259; EP 2 314 762 A1, column 3, lines 10 ff.; U.S. Pat. No. 5,437,315 A; U.S. Pat. No. 4,554,953 A) As indicated in EP 2 314 762 A1, these embodiments have the disadvantage that the first binder threads then have less presence in the first woven thread layer, i.e. larger recesses are produced at any binding point resulting in a more uneven surface on the paper side, which causes a worse paper fiber retention and a tendency of producing markings in the paper sheet.

SUMMARY OF THE INVENTION

It is an object of the invention to design a paper maker fabric particularly usable as a forming fabric in a forming section of a paper machine such that a strong connection between the two woven fabric layers is combined with a low tendency of paper sheet marking and a good fiber retention.

This object is achieved according to the invention in that at binding points only one first thread extending transversely to the binder thread is not bound by said binder thread. The basic idea of the invention is to obtain a strong connection between the two woven fabric layers by providing binder threads, which bind at some or any binding points at least two adjacent second threads by passing them on their machine side, but in difference to the state of the art only one first thread is not bound by the binder thread at the respective binding point. This results in a substantially continuous weave pattern being formed in the first woven fabric layer even at the binding points and hence, provides a more uniform surface of the paper side. It reduces the tendency of paper sheet marking substantially and consequently a more homogenous paper quality is obtained. Moreover, the fiber support is improved and the dewatering characteristic is more homogenous. The reduced risk of delamination due to binding of at least two second threads at one binding point results in a long operating time of the paper maker fabric.

It is not necessary that the inventive concept as characterized in claim 1 is realized at any binding point. However, it is preferred that the binder threads connect the two woven fabric layer at at least 50% or better 75% of all binding points as indicated in claim 1. Of course, it is the most preferred solution that the binder threads bind the second threads at any binding point in the sense of the present invention, i.e. by binding with at least two adjacent second threads releasing only one first thread not being bound at the binding point. Apart from that, it is not excluded that first threads forming binder threads for connecting the two woven fabric layers are provided additionally, which do not bind in accordance with the present invention, for example because they bind only one second thread at any binding point and/or release more than one first thread not being bound by the binder thread. However, also in this case, it is preferred that more than 50%, better more than 75% of the binder threads connect the two woven fabric layers in the sense of the present invention and that the most preferred solution is that all the binder threads are woven as described in claim 1. Finally, it is not excluded that additional binder threads are interwoven extending transversely to the binder threads in accordance with the invention and also, that binder threads are present which belong to the second woven fabric of second threads, and so, form intrinsic second threads.

In one embodiment of the invention, the binder threads interwoven in accordance with the present invention extend in the same direction, preferably transversely to the provided running direction of the paper maker fabric. Since forming fabrics are mostly woven flat, these binder threads form weft threads.

It may be sufficient to provide only one binder thread within one weave pattern repeat of the first woven fabric layer. In accordance with the requirements for the paper maker fabric, it might be desirable to have more than one binder threads within one weave pattern repeat, and it is not excluded that every first thread extending in the same direction is interwoven as a binder thread.

In a preferred embodiment of the invention, the binder threads running in accordance with the present invention are separated from the respective adjacent binder threads by at least one first thread not being a binder thread. This can also be more than one first thread, particularly two, three or four first threads not being binder threads. The number may depend on the necessity to obtain a sufficient strong connection between the two woven fabric layers.

In order to provide a good fiber retention and a low tendency of paper sheet marking, it is preferred that the first threads inclusive their binder threads form a plain weave on the paper side of the forming fabric. The second woven fabric layer may be woven according to an at least 4-shaft or harness and at most 24-shaft, particularly 6- or 8-shaft waving pattern.

The basic idea behind the present invention is suitable for woven paper maker fabrics with which the first threads extending transversely to the binder threads are present in a number of threads, which is at least as great as the number of the second threads extending parallel to the latter, i.e. the ratio of the thread numbers of these first and second threads is 1:1. However, ratios of 2:1, 3:2, 4:3, 5:3 or 5:4 can also be considered without any restriction being associated with this. Moreover, it is possible that the second threads extending transversely to the binder threads are offset with respect to the first threads extending transversely to the binder threads so that the said second threads are arranged below a gap between two adjacent first threads extending transversely to the binder threads.

In one further embodiment, the second threads form floats at the machine side passing under a number of second threads extending transversely to the floats on the machine side, which is larger than the number of these second threads, which are bound by the second threads between their floats. Such long floats provide good protection against abrasion caused particularly by the suction boxes of the paper making machine. The floats may be formed by second threads being interwoven as weft threads.

Suitable as materials for the threads are all of the synthetics, which are generally used for paper maker fabrics, and in particular forming fabrics. It is advantageous that the threads extending in the provided running direction of the paper maker fabric are made of polyethylene terephthalate (PET), polyethylene naphthalate (PEN) or mixtures or copolymers of these materials. The threads extending transversely to the provided running direction should be made of PET, polyamide (PA) or mixtures or copolymers of these materials or blends of these materials with polyurethane (PU).

As regards the cross-sectional shape of the threads, all known cross-sectional shapes are possible, in particular round, oval, rectangular cross-sections or those with other profiles being different to the above mentioned cross-sections. Moreover, threads can be provided which are twisted or braided from at least two monofilaments or multifilaments. Finally, threads can be used, which are provided with a coating, in particular made of urethane or acrylic, or using nanoparticles.

BRIEF DESCRIPTION OF THE DRAWINGS

In the drawings, the invention is illustrated by means of exemplary embodiments. These show as follows.

DETAILED DESCRIPTION OF THE PREFERRED EMBODIMENT(S)

Figure 1:
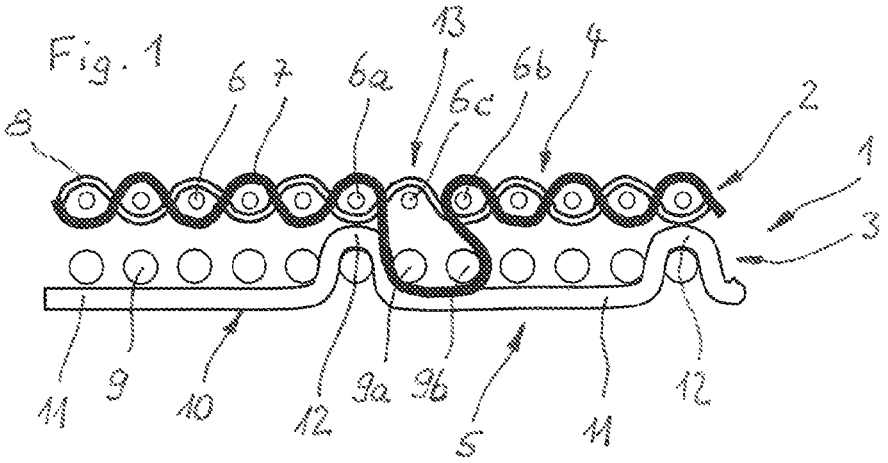
FIG. 1 a partial cross-section through a first woven paper maker fabric in accordance with the invention, FIG. 2 a partial cross-section through a second woven paper maker fabric in accordance with the invention.

The paper maker fabric 1 shown in FIG. 1 has a first woven fabric layer 2 and a second woven fabric layer 3. The two woven fabric layers 2, 3 are laid over one another. The outside of the first woven fabric layer 2 forms the paper side 4 and the outside of the second woven fabric layer 3 forms the machine side 5 of the paper maker fabric 1.

The first woven fabric layer 2 is made up of first longitudinal threads extending in the running direction of the paper maker fabric 1—identified for example by 6—and first transverse threads 7, 8 extending transversely to the latter, which both have a circular cross-section. The first transverse threads are composed of transverse binder threads 7 and first transverse threads 8 not being transverse binder threads 7. These two kinds of threads 7, 8 alternate one to another in the direction of the first longitudinal threads 6. The first transverse threads 7, 8 are in general interwoven in a plain weave.

The second woven fabric layer 3 is made up by second longitudinal threads—identified for example by 9—extending in the running direction and by second transverse threads 10, of which a single second transverse thread 10 is shown. The second transverse threads 10 run such that they form floats 11 on the machine side passing under five second longitudinal threads 9. Between the floats 11, the second transverse threads 10 bind with one second longitudinal thread 9 in a knuckle 12. Due to the long floats 11 of the second transverse threads 10 one talks of a weft runner. The second longitudinal threads 9 have a circular cross-section as well as the second transverse threads 10, too. The ratio of the numbers of the first longitudinal threads 6 and the second longitudinal threads 9 is 1:1.

At the binding point 13 the transverse binder thread 7 binds with a first longitudinal thread 6*a* by passing over its paper side, than changes from the first woven fabric layer 2 to the second woven fabric layer 3 by running nearly vertically, i.e. in thickness direction of the paper maker fabric 1, and binds in the second woven fabric layer 3 with two adjacent second longitudinal threads 9*a*, 9*b* by passing over their machine side. The two second longitudinal threads 9*a*, 9*b* are next to the knuckle 12 formed by the second transverse thread 10. Thereafter, the transverse binder thread 7 returns to the first woven fabric layer 2 and binds with a first longitudinal thread 6*b*. The first longitudinal threads 6*a*, 6*b* are separated by only one first longitudinal thread 6*c*. Consequently, at the binding point 13 only one first longitudinal thread 6*c* is being released from binding with the transverse binder thread 7, thus the plain weave structure being continued on the paper side of the forming fabric. Before and behind the binding point 13, the transverse binder thread 7 is interwoven with the other first threads 6, 8 in a plain weave, as well.

FIG. 1 shows only one binding point 13. The number of binding points 13 can be chosen in accordance with the necessity to obtain a sufficient strong connection between the first and second woven fabric layers 2, 3. So, binding with two longitudinal second threads 9 can be realized at any point behind any knuckle 12.

Figure 2:
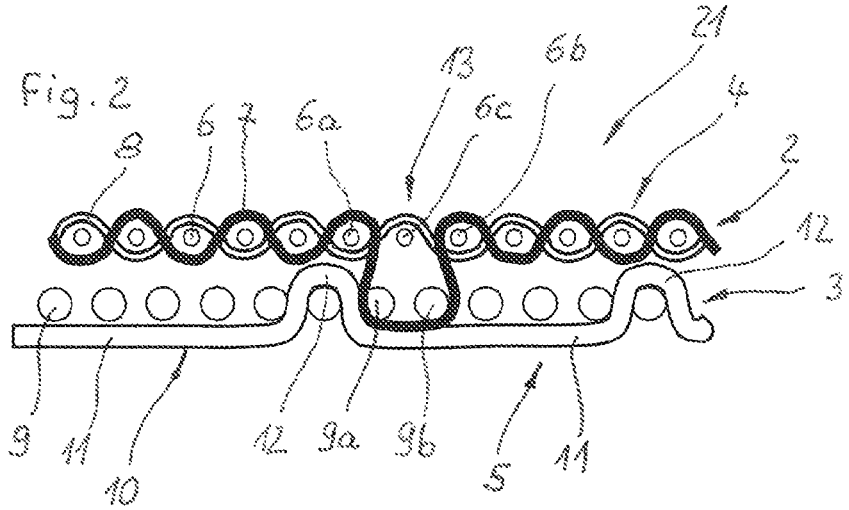

Another paper maker fabric 21 is illustrated in FIG. 2. It differs only slightly from the paper maker fabric 1 according to FIG. 1, and so here the reference numbers to be seen in FIG. 1 are used for the same parts in the woven paper maker fabric 21, and with regard to these parts, reference is made to the above mentioned description of the paper maker fabric 1 according to FIG. 1. The only difference is that in the paper maker fabric shown in FIG. 1 each second longitudinal thread 9 is exactly disposed below a single first longitudinal thread 6 forming pairs of first and second longitudinal threads 6, 9 lying one over the other, while the second longitudinal threads 9 of the paper maker fabric 21 are offset with respect to the first longitudinal threads 6 such that the second longitudinal threads 9 are disposed exactly below the middle of the gaps between the first longitudinal threads 6. A comparison between the two paper maker fabrics 1, 21 reveals that the course of the transverse binder thread 7 at the binding point 13 of the paper maker fabric 21 is more symmetrical than that of the transverse binder thread 7 in the paper maker fabric 1.

It will be apparent to one of ordinary skill in the art that various modifications and variations can be made in construction or configuration of the present invention without departing from the scope or spirit of the invention. Thus, it is intended that the present invention cover all modifications and variations of the invention, provided they come within the scope of the following claims and their equivalents.

I claim:

1. A paper maker fabric (1, 21) particularly usable as a forming fabric in a forming section of a paper making machine having a first woven fabric layer (2) forming a paper side on its outside and made of first threads (6, 7, 8) interwoven with one another, and a second woven fabric layer (3) forming a machine side on its outside and made of second threads (9, 10) interwoven with one another, the two woven fabric layers (2, 3) being connected to one another by intrinsic binder threads (7) belonging to the first woven fabric layer (2) such that at binding points (13) the respective binder thread (7) binds with a first thread (6*a*) extending transversely to the binder thread (7) by passing over its paper side, then changes to the second woven fabric layer (3) and binds with at least two adjacent second threads (9*a*, 9*b*) extending transversely to the binder thread (7) by passing over their machine side and then returns to the first woven fabric layer (2) again and binds with a first thread (6*b*) extending transversely to the binder thread (7) on the paper side, wherein at binding points (13) only one first thread (6*c*) extending transversely to the binder thread (7) is not bound by the said binder thread (7).

2. A paper maker fabric according to claim 1, wherein, the binder threads (7) extend transversely to the provided running direction of the paper maker fabric (1, 21).

3. A paper maker fabric according to claim 1, wherein, the binder threads (7) are weft threads.

4. A paper maker fabric according to claim 1, wherein, at least one binder thread (7) is provided within one weave pattern repeat of the first woven fabric layer (2).

5. A paper maker fabric according to claim 1, wherein, the binder threads (7) are separated from the respective adjacent binder threads (7) by at least one first thread (8) extending in the same direction and not being a binder thread (7), respectively.

6. A paper maker fabric according to claim 5, wherein, the binder threads (7) are separated from the respective adjacent binder thread (7) by more than one first thread (8) not being a binder thread (7).

7. A paper maker fabric according to claim 1, wherein, the first threads (6, 8) inclusive of their binder threads (7) form a plain weave on the paper side of the forming fabric (1, 21).

8. A paper maker fabric according to claim 1, wherein, the ratio of the number of the first threads (6) extending transversely to the binder threads (7) to the number of the second threads (9) extending transversely to the binder threads (7) amounts to 1:1, 2:1, 3.2, 4:3, 5:3 or 5:4.

9. A paper maker fabric according to claim 1, wherein, the second threads (9) extending transversely to the binder threads (7) are offset with respect to the first threads (6) extending transversely to the binder threads (7) so that the said second threads (9) are arranged below a gap between two adjacent first threads (6) extending transversely to the binder threads (7).

10. A paper maker fabric according to claim 1, wherein, said second threads (10) form floats (11) at the machine side passing a number of second threads (9) extending transversely to the floats (11) on the machine side, which is larger than the number of the second threads (9) which are bound by the second threads (10) between their floats (11).

11. A paper maker fabric according to claim 1, wherein, the threads (6, 9) extending in the running direction of the paper maker fabric (1, 21) are made of PET, PEN or of mixtures or copolymers of these materials and/or the threads (7, 8, 10) extending transversely to the provided running direction are made of PET, PA or mixtures or copolymers of these materials or blends of these materials with PU or other material suitable for use in the paper maker fabric.

12. A paper maker fabric according to claim 1, wherein, the threads (6, 7, 8, 9, 10) have a round, oval, or rectangular cross section or one with a profile being different to the above mentioned cross sections.

13. A paper maker fabric according to claim 1, wherein, threads are provided, which are twisted or braided from at least two monofilaments or multifilaments and/or which are provided with a coating, in particular made of urethane or acrylic, or using nanoparticles.

14. A paper maker fabric according to claim 2, wherein, at least one binder thread (7) is provided within one weave pattern repeat of the first woven fabric layer (2).

15. A paper maker fabric according to claim 3, wherein, at least one binder thread (7) is provided within one weave pattern repeat of the first woven fabric layer (2).

16. A paper maker fabric according to claim 2, wherein, the binder threads (7) are separated from the respective adjacent binder threads (7) by at least one first thread (8) extending in the same direction and not being a binder thread (7), respectively.

17. A paper maker fabric according to claim 3, wherein, the binder threads (7) are separated from the respective adjacent binder threads (7) by at least one first thread (8) extending in the same direction and not being a binder thread (7), respectively.

18. A paper maker fabric according to claim 4, wherein, the binder threads (7) are separated from the respective adjacent binder threads (7) by at least one first thread (8) extending in the same direction and not being a binder thread (7), respectively.

19. A paper maker fabric according to claim 5, wherein, the binder threads (7) are separated from the respective adjacent binder thread (7) by more than one first thread (8) not being a binder thread (7), and wherein the number of first threads (8) not being binder threads between two adjacent binder threads (7) is four at most.

20. A paper maker fabric (1, 21) particularly usable as a forming fabric in a forming section of a paper making machine having a first woven fabric layer (2) forming a paper side on its outside and made of first threads (6, 7, 8) interwoven with one another, and a second woven fabric layer (3) forming a machine side on its outside and made of second threads (9, 10) interwoven with one another, the two woven fabric layers (2, 3) being connected to one another by integral binder threads (7) belonging to the first woven fabric layer (2) such that at binding points (13) the respective binder thread (7) binds with a first thread (6*a*) extending transversely to the binder thread (7) by passing over its paper side, then changes to the second woven fabric layer (3) and binds with at least two adjacent second threads (9*a*, 9*b*) extending transversely to the binder thread (7) by passing over their machine side and then returns to the first woven fabric layer (2) again and binds with a first thread (6*b*) extending transversely to the binder thread (7) on the paper side, wherein at binding points (13) only one first thread (6*c*) extending transversely to the binder thread (7) is not bound by the said binder thread (7), wherein all the first threads extending in the same direction are interwoven as binder threads (7).

* * * * *